US007862120B2

(12) United States Patent
Ueda

(10) Patent No.: US 7,862,120 B2
(45) Date of Patent: Jan. 4, 2011

(54) CHAIR

(75) Inventor: Nobuyuki Ueda, Osaka (JP)

(73) Assignee: Kokuyo Furniture Co., Ltd., Osaka-shi (JP)

( * ) Notice: Subject to any disclaimer, the term of this patent is extended or adjusted under 35 U.S.C. 154(b) by 398 days.

(21) Appl. No.: 11/594,857

(22) Filed: Nov. 9, 2006

(65) Prior Publication Data

US 2007/0108821 A1 May 17, 2007

(30) Foreign Application Priority Data

Nov. 11, 2005 (JP) ..... 2005-328154

(51) Int. Cl.
*A47C 1/032* (2006.01)

(52) U.S. Cl. ..... 297/297; 297/285; 297/300.2; 297/301.1

(58) Field of Classification Search ..... 297/284.3, 297/285, 291, 296, 297, 298, 300.1, 300.2, 297/301.1, 354.11, 452.13
See application file for complete search history.

(56) References Cited

U.S. PATENT DOCUMENTS

| | | | | |
|---|---|---|---|---|
| 293,813 | A | 2/1884 | St. John | |
| 2,083,838 | A | 6/1937 | Goenen et al. | |
| 2,538,507 | A | 1/1951 | Cramer | |
| 3,133,763 | A | 5/1964 | Stoll et al. | |
| 3,938,858 | A | 2/1976 | Drabert et al. | |
| 4,090,700 | A | 5/1978 | Davis | |
| 4,549,764 | A | 10/1985 | Haedo | |
| 4,575,150 | A | 3/1986 | Smith | |
| 4,640,548 | A | 2/1987 | Desanta | |
| 4,709,963 | A | 12/1987 | Uecker et al. | |
| 4,830,430 | A | 5/1989 | Schafer | |
| 4,834,453 | A | 5/1989 | Makiol | |
| 4,869,552 | A | 9/1989 | Tolleson et al. | |
| 5,046,780 | A | 9/1991 | Decker et al. | |
| 5,172,930 | A | 12/1992 | Boye et al. | |
| 5,249,839 | A | 10/1993 | Faiks et al. | |
| 5,348,372 | A | 9/1994 | Takamatsu et al. | |
| 5,385,388 | A * | 1/1995 | Faiks et al. | 297/301.3 |
| 5,649,739 | A * | 7/1997 | Zapf | 297/301.1 |

(Continued)

FOREIGN PATENT DOCUMENTS

| | | | |
|---|---|---|---|
| DE | 199 30 922 | A1 | 5/2000 |

(Continued)

OTHER PUBLICATIONS

European Search Report dated Feb. 16, 2007, issued in corresponding European Patent Application No. 06123871.

(Continued)

*Primary Examiner*—Peter R. Brown
(74) *Attorney, Agent, or Firm*—Westerman, Hattori, Daniels & Adrian, LLP

(57) ABSTRACT

The invention achieves a chair in which a shape of a backrest surface can be three-dimensionally changed while following a motion such as a sitting person looks around while sitting or the like. In a chair provided with a backrest in which an upper portion of a backrest surface is supported by a plurality of frame elements arranged so as to be spaced with each other in a width direction, the respective frame elements are independently movable backward and forward.

9 Claims, 15 Drawing Sheets

U.S. PATENT DOCUMENTS

| | | | | |
|---|---|---|---|---|
| 5,904,397 | A | 5/1999 | Fismen | |
| 5,951,109 | A | 9/1999 | Roslund, Jr. et al. | |
| 5,988,746 | A * | 11/1999 | Raftery | 297/297 |
| 6,050,646 | A * | 4/2000 | Stenzel et al. | 297/452.59 |
| 6,056,361 | A | 5/2000 | Cvek | |
| 6,086,153 | A | 7/2000 | Heidmann et al. | |
| 6,116,687 | A | 9/2000 | Vogtherr | |
| 6,120,097 | A * | 9/2000 | Perry et al. | 297/325 |
| 6,149,236 | A * | 11/2000 | Brauning | 297/301.2 |
| 6,189,971 | B1 | 2/2001 | Witzig | |
| 6,220,661 | B1 | 4/2001 | Peterson | |
| 6,257,665 | B1 | 7/2001 | Nagamitsu et al. | |
| 6,406,096 | B1 | 6/2002 | Barile, Sr. | |
| 6,439,661 | B1 | 8/2002 | Brauning | |
| 6,460,928 | B2 | 10/2002 | Knoblock et al. | |
| 6,517,156 | B1 | 2/2003 | Lin | |
| 6,523,898 | B1 | 2/2003 | Ball et al. | |
| 6,565,153 | B2 | 5/2003 | Hensel et al. | |
| 6,572,190 | B2 | 6/2003 | Koepke et al. | |
| 6,609,755 | B2 | 8/2003 | Koepke et al. | |
| 6,672,669 | B2 | 1/2004 | Chu et al. | |
| 6,695,403 | B1 | 2/2004 | Su | |
| 6,695,404 | B2 | 2/2004 | Bruske | |
| 6,729,688 | B2 | 5/2004 | Erne | |
| 6,761,406 | B2 * | 7/2004 | Kinoshita et al. | 297/296 |
| 6,767,066 | B1 * | 7/2004 | Tornero | 297/440.11 |
| D497,264 | S | 10/2004 | Aubriet et al. | |
| 6,811,215 | B2 | 11/2004 | Horiki et al. | |
| 6,843,530 | B1 | 1/2005 | Wu | |
| 6,913,316 | B2 | 7/2005 | Kinoshita et al. | |
| 6,991,291 | B2 | 1/2006 | Knoblock et al. | |
| 7,014,269 | B2 | 3/2006 | Coffield et al. | |
| 7,066,537 | B2 | 6/2006 | Coffield et al. | |
| 7,118,176 | B2 | 10/2006 | Erker | |
| 7,226,127 | B1 * | 6/2007 | Yevko et al. | 297/284.1 |
| 7,273,253 | B2 | 9/2007 | Deimen et al. | |
| 7,396,079 | B2 * | 7/2008 | Heidmann et al. | 297/285 |
| 7,422,287 | B2 * | 9/2008 | Heidmann et al. | 297/354.1 |
| 7,434,879 | B2 | 10/2008 | Ueda et al. | |
| 2002/0117883 | A1 | 8/2002 | Gevaert | |
| 2002/0180248 | A1 | 12/2002 | Kinoshita et al. | |
| 2002/0180250 | A1 | 12/2002 | Kinoshita et al. | |
| 2002/0180252 | A1 | 12/2002 | Kinoshita et al. | |
| 2002/0190553 | A1 | 12/2002 | Koepke et al. | |
| 2002/0190555 | A1 | 12/2002 | Holbrook et al. | |
| 2003/0127896 | A1 | 7/2003 | Deimen et al. | |
| 2004/0012237 | A1 * | 1/2004 | Horiki et al. | 297/440.11 |
| 2004/0066075 | A1 * | 4/2004 | Yeh | 297/354.1 |
| 2004/0140701 | A1 | 7/2004 | Schmitz et al. | |
| 2004/0183350 | A1 | 9/2004 | Schmitz et al. | |
| 2007/0108819 | A1 | 5/2007 | Ueda | |
| 2007/0108820 | A1 | 5/2007 | Ueda | |
| 2007/0108822 | A1 | 5/2007 | Ueda | |
| 2007/0108831 | A1 | 5/2007 | Ueda | |
| 2008/0030059 | A1 | 2/2008 | Deimen et al. | |

FOREIGN PATENT DOCUMENTS

| | | | |
|---|---|---|---|
| DE | 101 47 021 | | 4/2003 |
| EP | 0 259 609 | | 3/1988 |
| EP | 0 552 388 | A1 | 7/1993 |
| EP | 1 447 029 | | 8/2004 |
| EP | 1 447 029 | A1 | 8/2004 |
| FR | 2627968 | | 9/1989 |
| GB | 610741 | | 10/1948 |
| GB | 2 143 730 | A | 2/1985 |
| JP | 61041028 | | 2/1986 |
| JP | 2616332 | B2 | 6/1997 |
| JP | 2002-119373 | A | 4/2002 |
| JP | 2002-119375 | A | 4/2002 |
| JP | 2003-265256 | A | 9/2003 |
| NL | 7 804 978 | A | 11/1978 |
| WO | WO 86/02243 | | 4/1986 |
| WO | WO 94/27472 | A1 | 12/1994 |
| WO | WO 00/22961 | A1 | 4/2000 |

OTHER PUBLICATIONS

European Office Action dated Mar. 29, 2007, Application No. 06123872.1-1258 of co-pending U.S. Appl. No. 11/594,835.

European Search Report dated Jan. 30, 2007 issued in corresponding European Application No. 06 12 3875 of co-pending U.S. Appl. No. 11/594,836.

European Search Report dated Feb. 1, 2007, issued in corresponding application EP 06 12 3869 of co-pending U.S. Appl. No. 11/594,837.

European Search Report mailed Mar. 12, 2007, issued in corresponding application EP 06 12 3874 of co-pending U.S. Appl. No. 11/594,834.

European Search Report dated Apr. 16, 2007 issued in corresponding EP Application No. 06123876.2-1258 of co-pending U.S. Appl. No. 11/594,858.

* cited by examiner 142
1
141a
141b
Hinge
17
14
18
12
3
11
13
131a
32
17
151a
131b
15
42
151b
41
4

CHAIR

BACKGROUND OF THE INVENTION

1. Field of the Invention

The present invention relates to a chair in which a shape of a backrest surface can be three-dimensionally changed while following a motion of a body of a person sitting thereon.

2. Description of the Related Art

There has been known a chair in which a backrest surface is structured by bridging an upholstery member between a pair of frame elements formed in both right and left sides. For example, Japanese Unexamined Patent Publication No. 2002-119375 and Japanese Unexamined Patent Publication No. 2002-119373 disclose a chair in which an upper portion of a backrest surface is supported by an upper frame element, a lower portion of the backrest surface is supported by a lower frame element, and the backrest surface can be formed in correspondence to a body type and a backbone shape of a sitting person through a rotating operation of the upper frame element and a rotating operation around a horizontal axis of the lower frame element.

In this case, as everyday concerns, a person frequently looks around, reaches out a hand or twist himself or herself while sitting on a chair. The motion is executed for various purposes such as turning to a calling person, taking up a goods at the back, easing the stiffness by stretch or the like. However, the conventional chair does not take into consideration following the motion of the sitting person.

More specifically speaking, when looking around, reaching out a hand or twisting himself or herself while sitting on the chair, a left side of the body or a right side of the body is relatively turned down backward. However, in the existing chair such as the example mentioned above, since both the right and left frame elements are rigidly coupled to each other via a lateral bridging member, and these frame elements are integrally moved backward and forward, it is impossible to make only a left side portion or a right side portion of the backrest surface displace backward. Accordingly, it is impossible to deform the backrest surface while following the motion such as the sitting person looks around or the like, and a motion of the sitting person is limited.

SUMMARY OF THE INVENTION

The present invention is made by first paying attention to the above problem, and an object of the present invention is to achieve a chair in which a shape of a backrest surface can be three-dimensionally changed while following a motion such as a sitting person looks around while sitting or the like.

In order to solve the problem mentioned above, in accordance with the present invention, there is provided a chair comprising a backrest in which an upper portion of a backrest surface is supported by a plurality of frame elements arranged so as to be spaced with each other in a width direction, wherein the respective frame elements are independently movable backward and forward. In this case, the backrest surface means generally a structure which is structured by an element such as an upholstery member, a cushion member or the other members, and supports a body of a sitting person so as to receive a load thereof. Further, "independently movable backward and forward" means that one frame element can be relatively displaced with respect to the other frame element in a backward and forward direction. The structure mentioned above can make only a left half portion of the upper portion of the backrest surface or only a right half portion displace backward. Further, it is possible to three-dimensionally displace the shape of the backrest surface while following the motion of the sitting person such as the sitting person looks around or the like, and it is possible to achieve the chair having an improved comfortable sitting feeling which can preferably keep supporting the body of the sitting person without vainly limiting the motion of the sitting person.

In preferable, each of a plurality of upper frame elements supporting the upper portion of the backrest surface is capable of being individually displaced in the backward and forward direction without displacing a lower frame element supporting a lower portion of the backrest surface. When the sitting person executes a motion such as looking around, a neck, shoulders and a back are twisted so as to be largely turned, however, a body portion below a lumber is not turned so much, in accordance with a natural body position. Therefore, the backrest surface is user-friendly in a case where it is not flexibly deformed so much below the vicinity of the lumber portion of the sitting person, and it is considered that no additional load is hard to be applied to the sitting person.

In order to achieve the chair which can selectively execute a motion of integrally tilting an entire of the backrest surface and a motion of tilting only an upper portion of the backrest surface, it is simple to structure such that one of the upper frame elements can be relatively tilted backward with respect to the other by coupling the upper frame elements to the lower frame elements via hinges.

If the structure is made such that a reaction force frame element is provided so as to be connected to a back surface of a frame element supporting an upper portion of the backrest surface and accumulate a reaction force based on an elastic deformation, and the frame element is supported from behind by the reaction force frame element, it is not necessary that a coil spring or the like is interior provided in the inside of the hinge portion, and it is possible to prevent the hinge portion from being enlarged. In addition, it is possible to prevent an uncomfortable feeling from being applied to an existence of the reaction force frame element by forming the reaction force frame element as an outer appearance like a part of the back frame, and it is possible to keep beauty and elegance as a furniture.

Since the frame element supporting the upper portion of the backrest surface indirectly receives the load of the sitting person via the backrest surface so as to tend to fall down in the width direction, it is desirable to couple a plurality of frame elements to each other via an elastically deformable lateral bridging member.

If the lateral bridging member is assembled in a state of achieving an initial elastic force such as to move the frame elements away from each other in the width direction, against the matter that the load is applied to the backrest surface and the frame elements tend to fall down to the inner side, it is possible to cancel and reduce the load applied to the frame elements and the hinges.

Further, in correspondence to the motion of the sitting person, one of the frame elements is relatively displaced with respect to the other and a distance between the frame elements is increased. Accordingly, the lateral bridging member is assembled in a state of being formed in a curved shape in a plan view so as to be deformed in such a manner as to reduce a curvature at a time when one of the frame elements is relatively moved backward and forward with respect to the other, whereby it is possible to correspond to an increase of the clearance between the frame elements.

In addition, the backrest surface is structured by attaching an elastically deformable upholstery member on front surfaces of the plurality of frame elements, whereby it is possible to provide a soft sitting feeling having a reduced load by deforming while following various motions of the sitting person and fitting to a wide range of the body.

In accordance with the present invention, it is possible to achieve the seat which can three-dimensionally change the shape of the backrest surface while following the motion of the sitting person such as looking around while sitting or the like.

DESCRIPTION OF THE PREFERRED EMBODIMENTS

Figure 1:
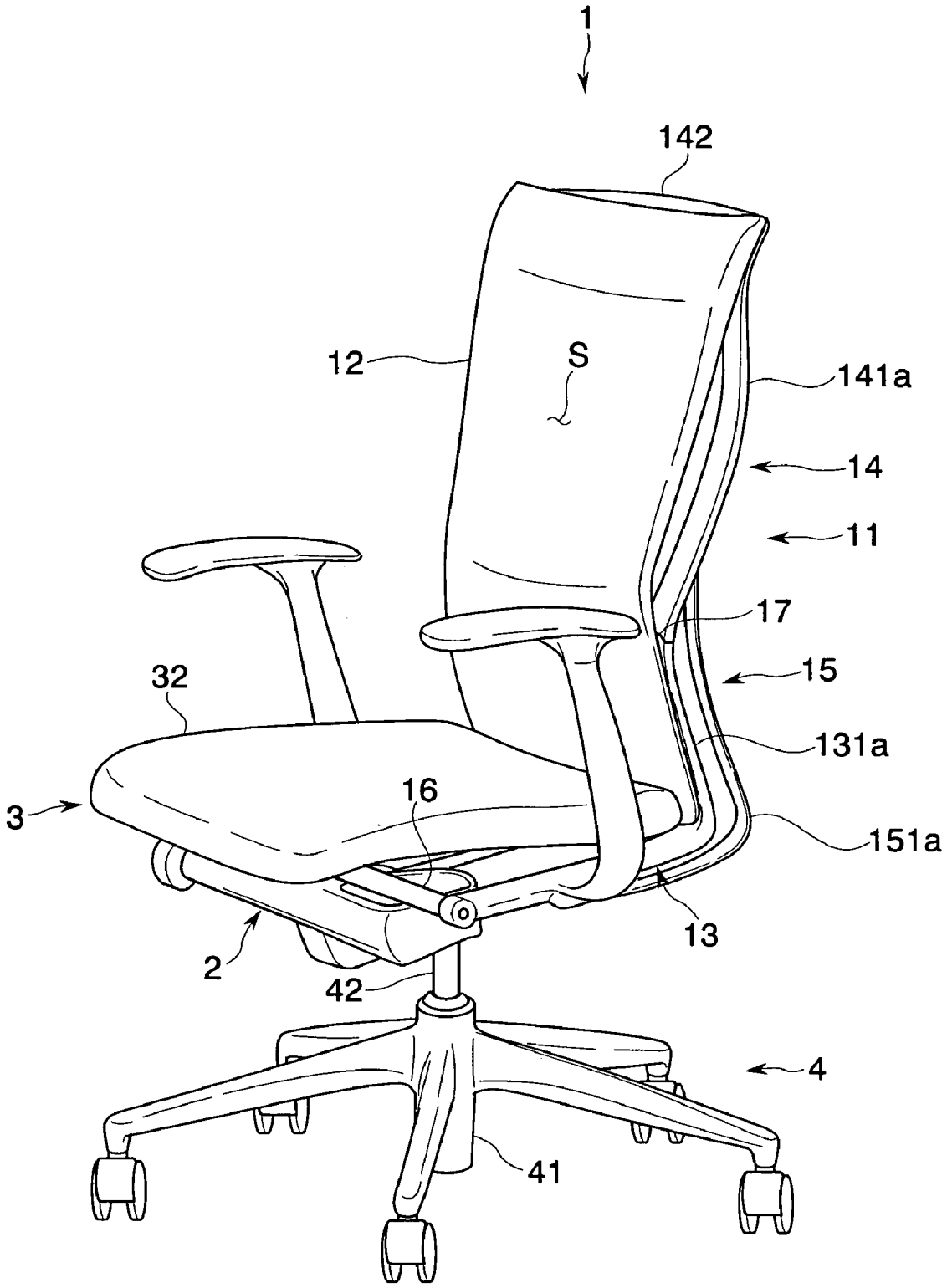
FIG. 1 is a perspective view of a chair in accordance with an embodiment of the present invention as seen from a front surface side.
Figure 2:
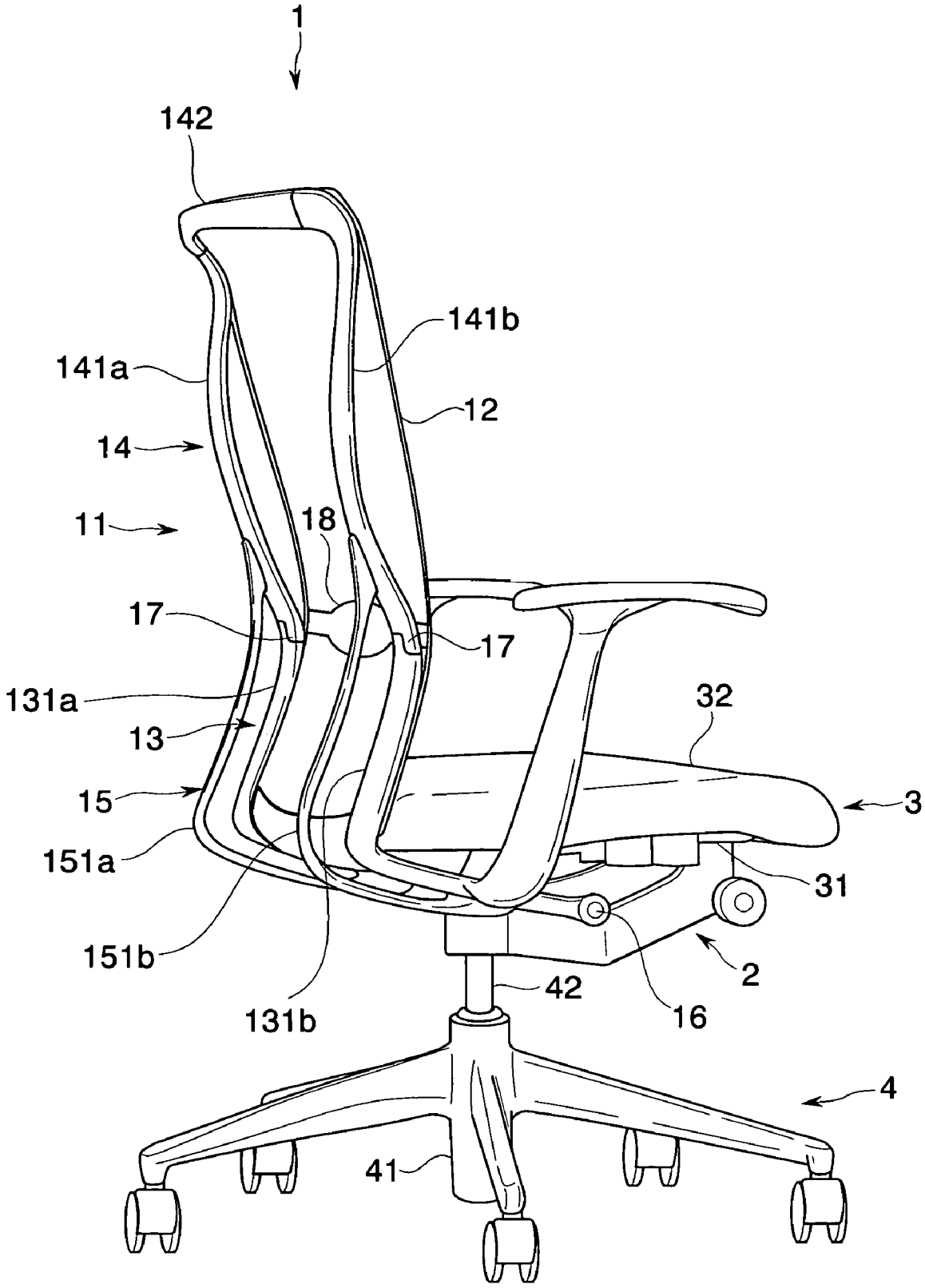
FIG. 2 is a perspective view of the chair as seen from a back surface side.
Figure 3:
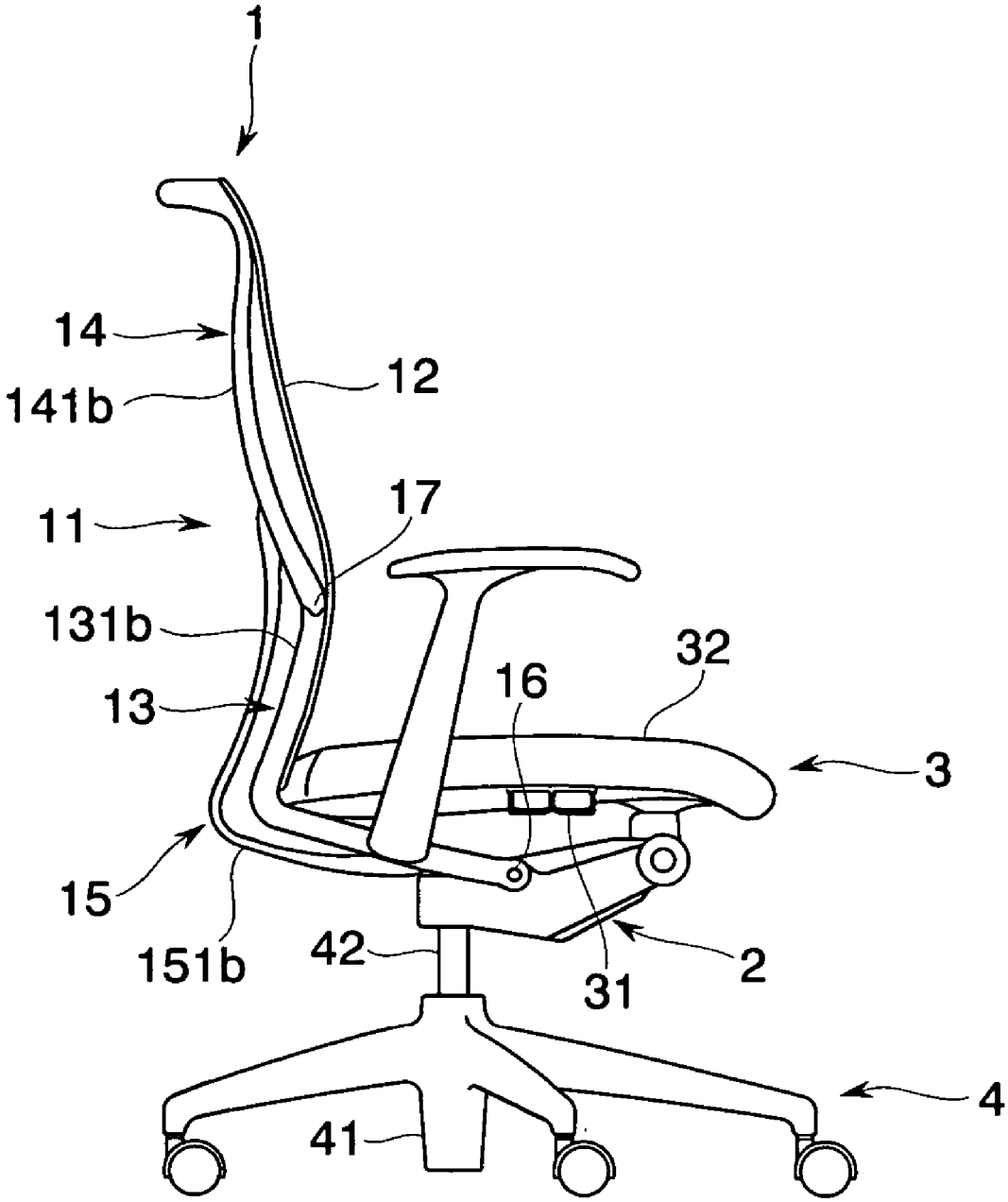
FIG. 3 is a side elevational view of the chair.
Figure 4:
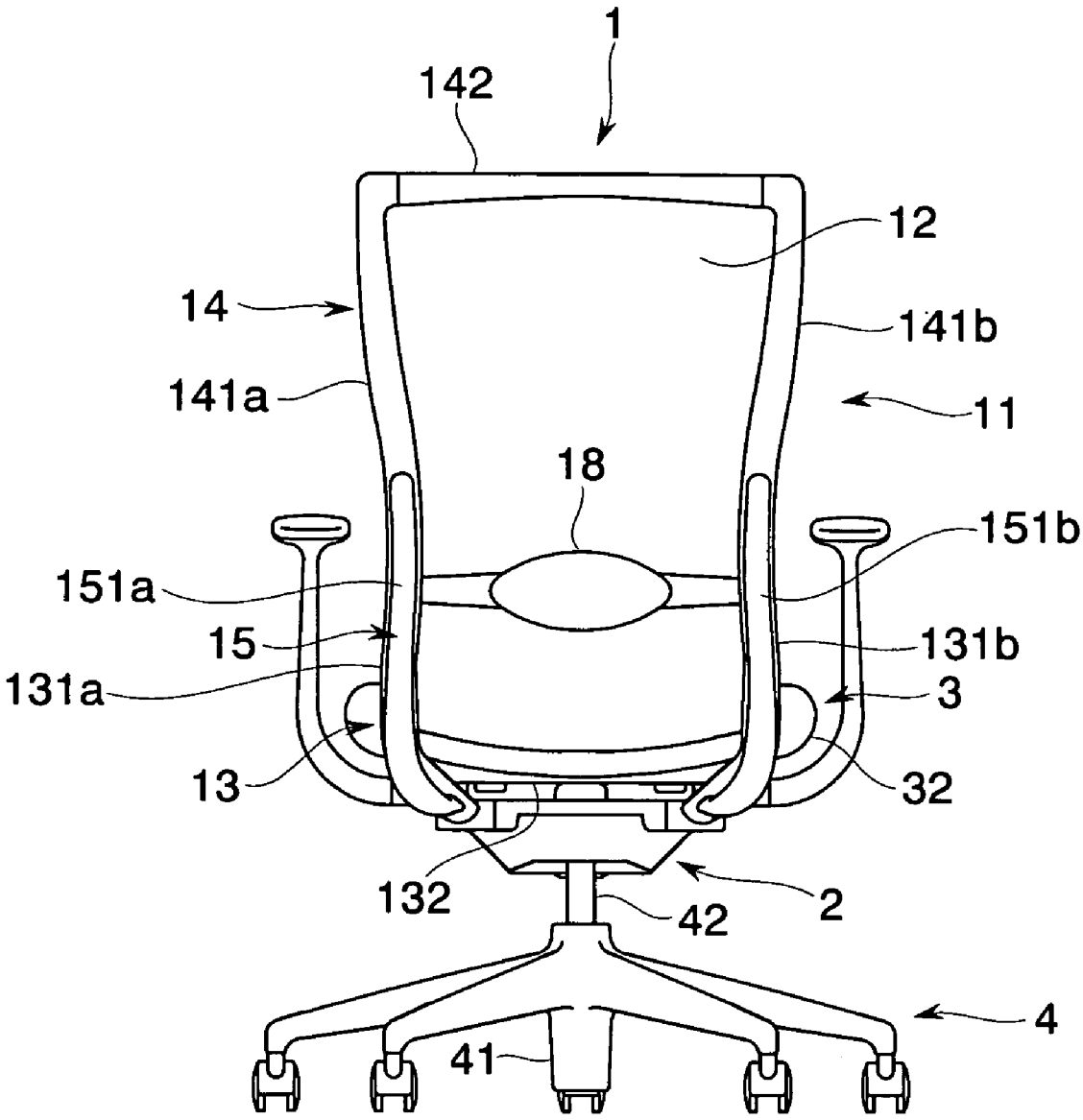
FIG. 4 is a rear elevational view of the chair.
Figure 5:
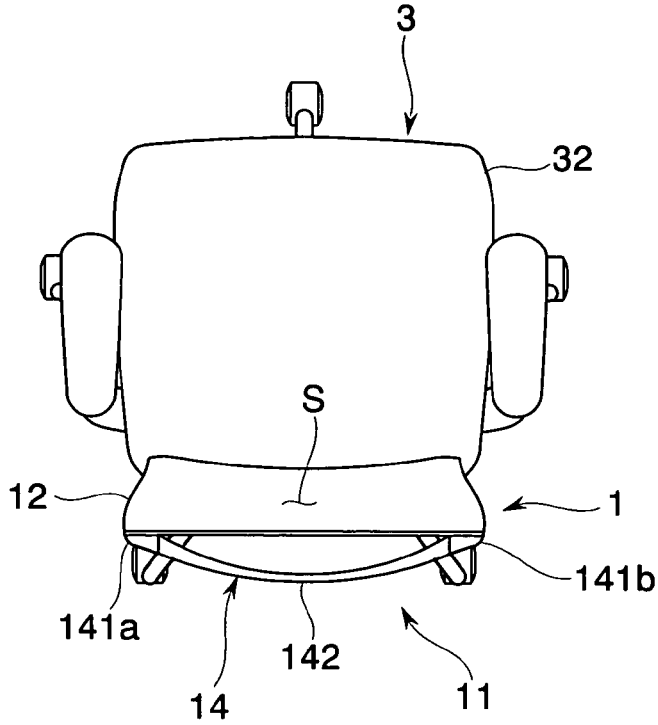
FIG. 5 is a plan view of the chair.

A description will be given below of an embodiment in accordance with the present invention with reference to the accompanying drawings. A chair in accordance with the present embodiment is provided with a leg body 4, a base body 2 supported by a leg body 4, a seat 3 arranged on the base body 2, and a backrest 1 pivoted to the base body 2 via a horizontal supporting shaft 16, as shown in FIGS. 1 to 5, and is structured such that the seat 3 and the backrest 1 are tilted in an interlocking manner, whereby a synchronized rocking motion can be executed.

In detail speaking, the leg body 4 is provided with a leg wing 41 to which a plurality of casters are installed, and a leg support pillar 42 uprising approximately vertically from a center of the leg blade 41, and the leg support pillar 42 can be protruded and contracted up and down based on expansion and contraction of a gas spring (not shown) interposed between the leg wing 41 and the leg support pillar 42.

The base body 2 is fixed to an upper end of the leg support pillar 42, and it is possible to adjust height positions of the seat 3 and the backrest 1 in accordance with the protruding and contracting operation of the leg support pillar 42. The base body 2 has an elastic energizing mechanism (not shown) energizing the backrest 1 rotating around a horizontal support pillar 16 forward, a fixing mechanism (not shown) fixing a rocking angle of the backrest 1 and the like built-in. The elastic energizing mechanism is structured such that a coil sprig and a gas spring are mounted so as to elastically energize a back frame 11. The fixing mechanism is structured, for example, such that a pawl is selectively engaged with any one of plural stages of recesses provided in the back frame 11 side so as to fix the rocking angle. However, in a case where a push-lock type gas spring is used in the elastic energizing mechanism, the fixing mechanism can employ an aspect of driving a valve thereof so as to inhibit an expansion and contraction motion of the gas spring.

The seat 3 is structured such that a cushion body 32 constituting a seat surface is installed to a seat receiver 31. The cushion body 32 has a two-layer structure, for example, made such that an urethane cushion member is layered on a double raschel mesh of a synthetic fiber, in which the mesh in the lower layer secures a suitable elasticity while absorbing an impact, and the urethane cushion in the upper layer keeps a stability of an attitude. A front end portion of the seat 3 is supported so as to be slidable in a backward and forward direction with respect to the base body 2, and a rear end portion of the seat 3 is attached to a lower frame portion 13 in the back frame 11 via a hinge (not shown).

The backrest 1 is structured such that a tension member 12 constituting a backrest surface S is attached to a front surface of the back frame 11. The back frame 11 is provided with a lower frame portion 13 coupled so as to be rotatable around the horizontal support shaft 16 with respect to the base body 2, an upper frame portion 14 coupled to an upper end of the lower frame portion 13 via a hinge 17, and a reaction force frame portion 15 supporting the upper frame portion 14 from a rear side.

The lower frame portion 13 is structured by coupling left and right lower frame elements 131*a* and 131*b* arranged so as to be spaced with each other in a width direction by a rigid lateral bridging member 132. Both of the lower frame elements 131*a* and 131*b*, and the rigid lateral bridging member 132 are constituted, for example, by a rigid body made of a metal. The lower frame elements 131*a* and 131*b* extend backward from a front end where the horizontal support shaft 16 is positioned, and are formed in an approximately L shape bent upward in a rear end in a side view.

The upper frame portion 14 is structured by coupling left and right upper frame elements 141*a* and 141*b* arranged so as to be spaced with each other in the width direction by an elastic lateral bridging member 142. Both of the upper frame elements 141*a* and 141*b* are constituted, for example, by a rigid body made of a metal, however, the elastic lateral bridging member 142 is constituted, for example, by an elastic body made of a resin. The upper frame elements 141*a* and 141*b* extend upward while being gently curved so as to be depressed backward to some extent, from a lower end where the hinge 17 is positioned, and are formed in an arch shape swelling forward again near an upper end thereof in a side view.

The reaction force frame portion 15 is constituted by the same number of reaction force frame elements 151*a* and 151*b* respectively supporting the upper frame elements 141*a* and 141*b*. One end portions of the reaction force frame elements 151*a* and 151*b* are connected to back surfaces of the upper frame elements 141*a* and 141*b*, and the other end portions are connected to downward surfaces of the lower frame elements 131*a* and 131*b*. In this case, the other end portions of the reaction force frame elements 151*a* and 151*b* may be fixed to the base body 2 supporting the seat 3 and the back rest 1. The reaction force frame elements 151*a* and 151*b* are constituted, for example, by an elastic body made of the same resin as the elastic lateral bridging member 142. In the present embodiment, the reaction force frame elements 151*a* and 151*b* are constituted by a frame-shaped resin spring extending along the lower frame elements 131*a* and 131*b* and the upper frame elements 141*a* and 141*b* so as to be formed in an approximately L shape in a side view, and are formed in such a manner that a width is equal to or narrower than that of the frame elements 131*a*, 131*b*, 141*a* and 141*b*, and thicknesses of the longitudinal part or vertical part thereof are thinner than that of the frame elements 131*a*, 131*b*, 141*a* and 141*b* (in addition, gradually thinner in accordance with setting apart from an end portion bonded to the frame elements 131*a*, 131*b*, 141*a* and 141*b*). Accordingly, it is possible to obtain an outer appearance such as the reaction force frame elements 151*a* and 151*b* are a part of the back frame 11 obtained by being branched from the frame elements 131*a*, 131*b*, 141*a* and 141*b*.

There is formed such a curved shape that the front surface of the frame swells forward in the side view, around the hinge 17 pivoting the lower frame elements 131*a* and 131*b* and the upper frame elements 141*a* and 141*b* to each other, specifically, in a range from the rear ends of the lower frame elements 131*a* and 131*b* to the upper ends and near the lower ends of the upper frame elements 141*a* and 141*b*. As mentioned already, there is formed such a curved shape that the front surface of the frame swells forward in the side view, near the upper ends of the upper frame elements 141*a* and 141*b*. Accordingly, the upholstery member 12 is attached in such a manner as to bridge over the curved positions of the lower frame elements 131*a* and 131*b* and the upper frame elements 141*a* and 141*b*.

Figure 10:
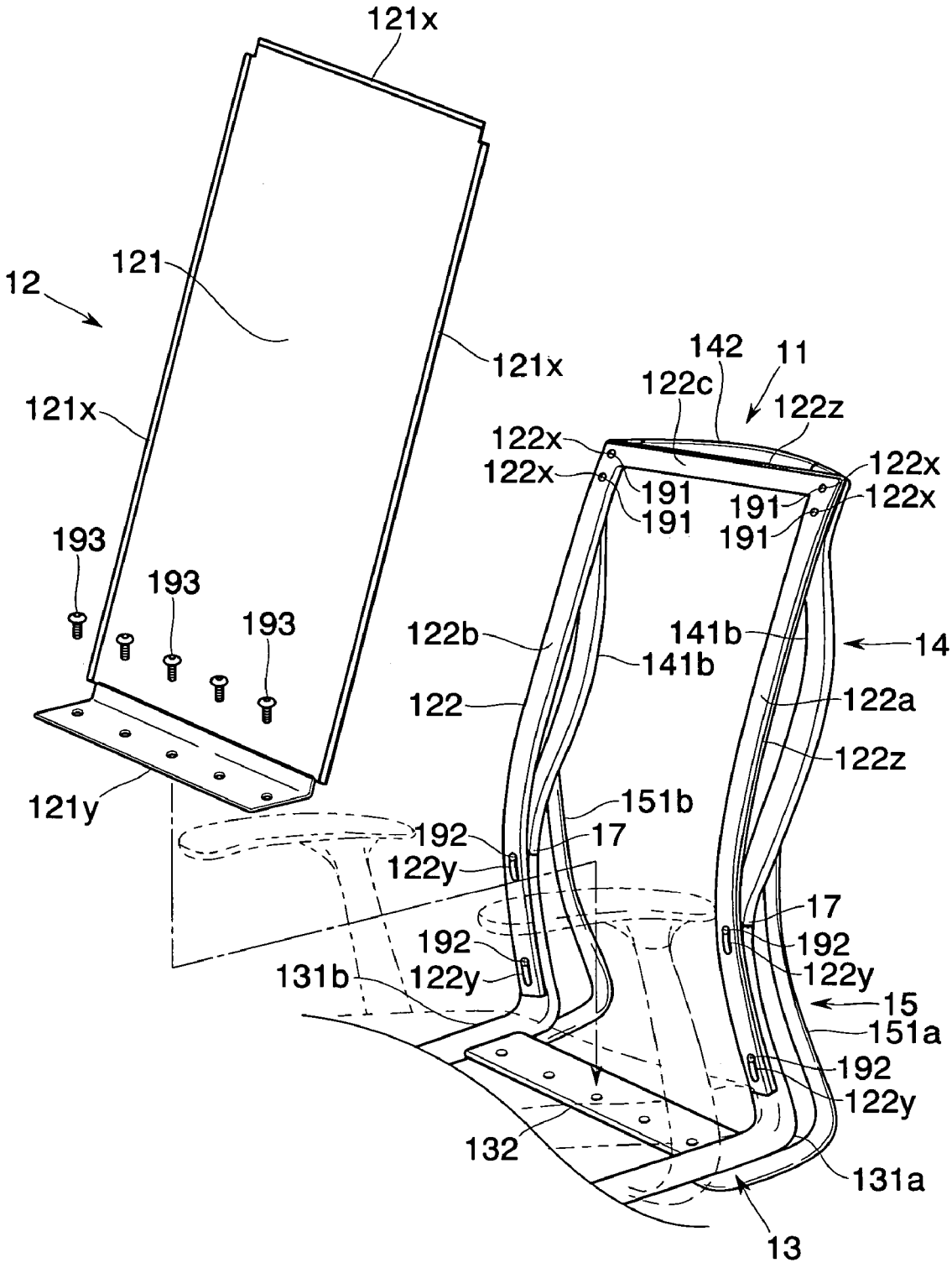
FIG. 10 is an exploded perspective view of a main portion and shows an upholstery member and a backup member of the chair.

The upholstery member 12 is mainly constituted by an upholstery fabric 121 which is rich in elasticity. The upholstery fabric 121 is formed, for example, by weaving an elastic yarn such as an elastomer yarn or the like in a double raschel mesh of a synthetic resin, and is provided with both of a strength and a cushioning characteristic. The upholstery fabric 121 is formed by weaving an outer material and an inner material each constituted by a flexibly deformable mesh material in accordance with a double raschel knitting stereoscopically, and an appearance (a color, a pattern, a gloss or the like) is different between the outer and inner sides. An upper line and right and left side lines of the upholstery fabric 121 are shape retained by a backup member 122. As shown in FIG. 10, the backup member 122 is formed in a three sided frame shape or a four sided frame shape in a front elevational view by vertical frames 122*a* and 122*b* forming a pair in both left and right sides and a lateral frame 122*c* coupling both the vertical frames 122*a* and 122*b*, is constituted by a thin plate body, for example, made of a resin, which is deflection deformable in a backward and forward direction, particularly prevents right and left side lines of the upholstery fabric 121 from being deflected to an inner side, and keeps the upholstery fabric 121 in a tensioned state. The backup member 122 in an illustrated embodiment is formed in an approximately three sided frame shape in a front elevational view in which upper end portions of both the left and right vertical frames 122*a* and 122*b* are coupled to each other via the lateral frame 122*c*.

An upper end portion of the backup member 122 is supported by an upper end portion of the back frame 11. In the present embodiment, a through hole 122*x* is made in upper end portions of the vertical frames 122*a* and 122*b* of the backup member 122, and a fastening device 191 such as a screw, a pin or the like is inserted to the through hole 122*x* and is fastened to stop end portions of the upper frame elements 141*a* and 141*b*. On the other hand, a lower end portion of the backup member 122 is supported by a lower end portion of the back frame 11. In the present embodiment, a long hole 122*y* extending in the vertical direction is made in each of positioned slightly below lower end portions and intermediate portions of the vertical frames 122*a* and 122*b* of the backup member 122, and a fastening device 192 such as a screw, a pin or the like is inserted to each of the long holes 122*y* so as to be fastened to lower end portions and upper end portions of the lower frame elements 131*a* and 131*b*. An upper end portion of the backup member 122 is fixed to the upper frame elements 141*a* and 141*b*, and a lower end portion thereof is vertically slidable with respect to the lower frame elements 131*a* and 131*b*.

A portion between the upper end portion of the back frame 11 and a portion near the hinge 17 is curved in such a manner as to be depressed backward in the side view, and admits of a backward deflection deforming of the intermediate positions of the vertical frames 122*a* and 122*b*. The elastic lateral bridging member 142 forming an upper line of the back frame 11 is also curved so as to be depressed backward in the plan view, and admits of a backward deflection deforming of the lateral frame 122*c*.

Figure 11:
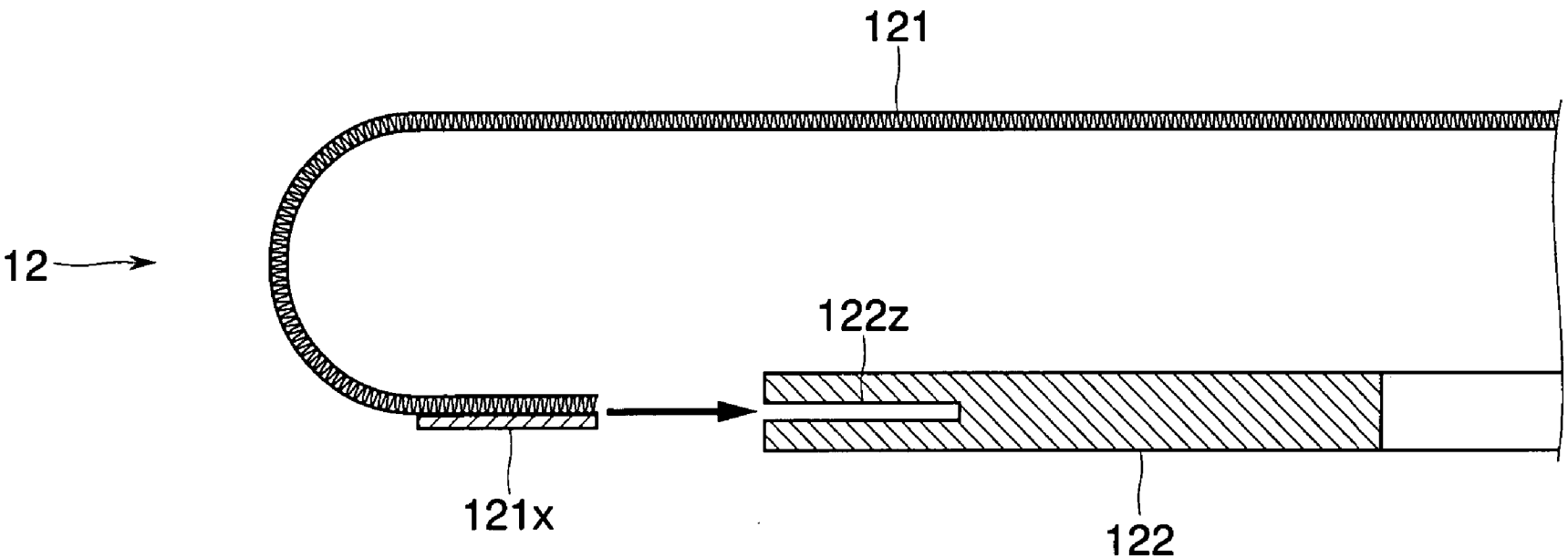
FIG. 11 is a plan cross sectional view of a major portion and shows an aspect that the upholstery member of the chair is installed to the backup member.

The upper end portion of the upholstery member 12 is installed to the left and right upper frame elements 141*a* and 141*bb* so as to be supported, and the lower end portion thereof is installed to the left and right lower frame elements 131*a* and 131*b* so as to be supported. When installing the upholstery fabric 121 o the back frame 11, an upper edge of the upholstery fabric 121 is installed to the lateral frame 122*c* of the backup member 122, and left and right side edges of the upholstery fabric 121 are installed to the vertical frames 122*a* and 122*b* of the backup material 122. In specific, as shown in FIGS. 10 and 11, a concave groove 122*z* is formed in each of a peripheral end surface of the backup member 122, that is, an upper end surface of the lateral frame 122*c* and outer end surfaces of the left and right vertical frames 122*a* and 122*b*, and three sides edge ends of the upholstery fabric 121 are fitted to the concave grooves 122*z* so as to be locked. Edge end members 121*x*, for example, made of a resin, formed in a long thin plate shape are previously attached to three sided edge ends of the upholstery fabric 121 (in accordance with a seaming, an adhesion, a welding or the like). Further, a lower edge of the upholstery fabric 121 is fixed to a predetermined position of the lower frame portion 13. In an illustrated embodiment, a bracket 121*y* is attached to a lower edge of the upholstery fabric 121, and the bracket 121*y* is fixed to a rigid lateral bridging member 132 of the lower frame portion 13 by using a bolt 193 or the like.

Totally speaking, the backup member 122 is arranged in a front surface of the back frame 11, and the upholstery fabric 121 is arranged on the front surface of the backup member 122. At this time, the backup member 122 serves as an operation of a leaf spring, and presses the upholstery fabric 121 forward so as to protrude.

In this connection, a lumbar support belt 18 may be bridged at a corresponding height position to the lumber portion of the sitting person, at the back of the upholstery member 12. Even in a case where the sitting person leans the body to the backrest surface S, the position bridging the lumber support belt 18 does not settle down backward over a depth corresponding to a length of the lumber support belt 18. Both end portions of the lumber support belt 18 are attached to the left and right vertical frames 122*a* and 122*b* of the backup member 122 so as to be supported. In this case, the both end portions of the lumber support belt 18 may be supported by the left and right upper frame elements 141*a* and 141*b* or the lower frame elements 131*a* and 131*b*.

Figure 6:
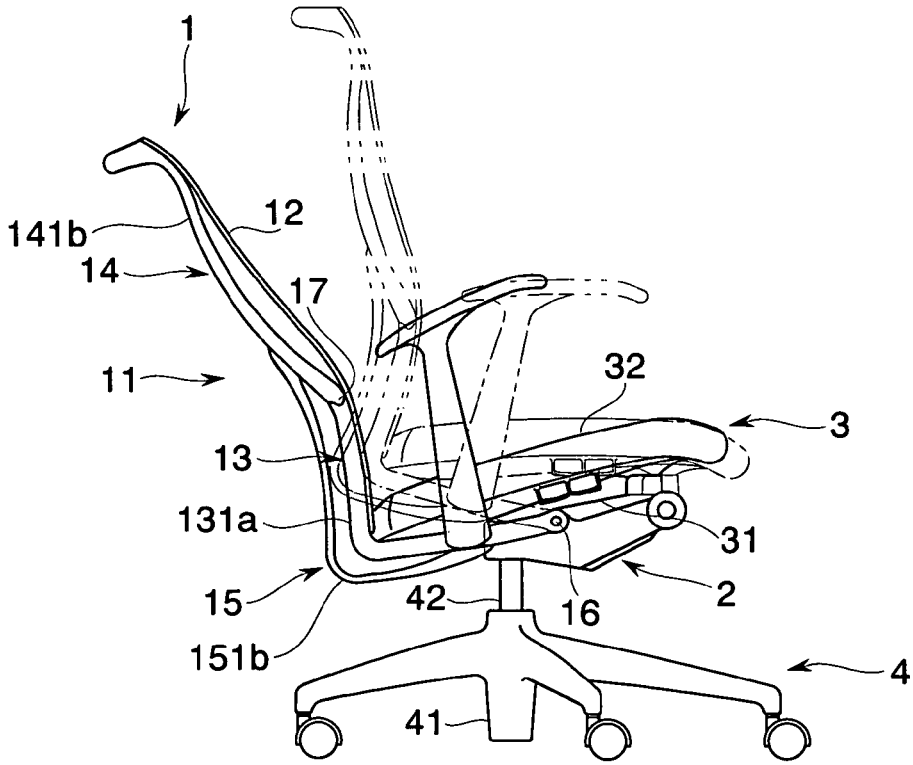
FIG. 6 is a side elevational view showing a synchronous rocking motion of the chair.

The chair in accordance with the present embodiment can execute a synchronous rocking motion in which the seat 3 and the backrest 1 are tilted in an interlocking manner. As shown in FIG. 6, in the synchronous rocking motion, an entire of the back frame 11 is rotated around the horizontal support shaft 16, whereby the backrest 1 is tilted backward and forward. At the same time, the rear end portion of the seat 3 is oscillated up and down working with the back frame 11, and the front end portion of the seat 3 is slid backward and forward.

In addition, the chair in accordance with the present embodiment can execute a motion in which only a left half portion of the upper portion of the backrest surface S or only a right half portion thereof is displaced backward following such a motion as the sitting person looks around, reaches out a hand or twist himself or herself while sitting on the chair. The upper frame portion 14 supporting the upper portion of the backrest surface S is structured such that the upper frame elements 141*a* and 141*b* forming a pair in left and right sides are moved backward and forward independently from each other. In other words, the upper frame element 141*a* in the left side is coupled to the lower frame element 131*a* in the left side via the hinge 17, and the upper frame element 141*b* in the right side is coupled to the lower frame element 131*b* in the right side via the hinge 17, whereby these upper frame elements 14*sa* and 141*b* can be individually rotated.

Figure 7:
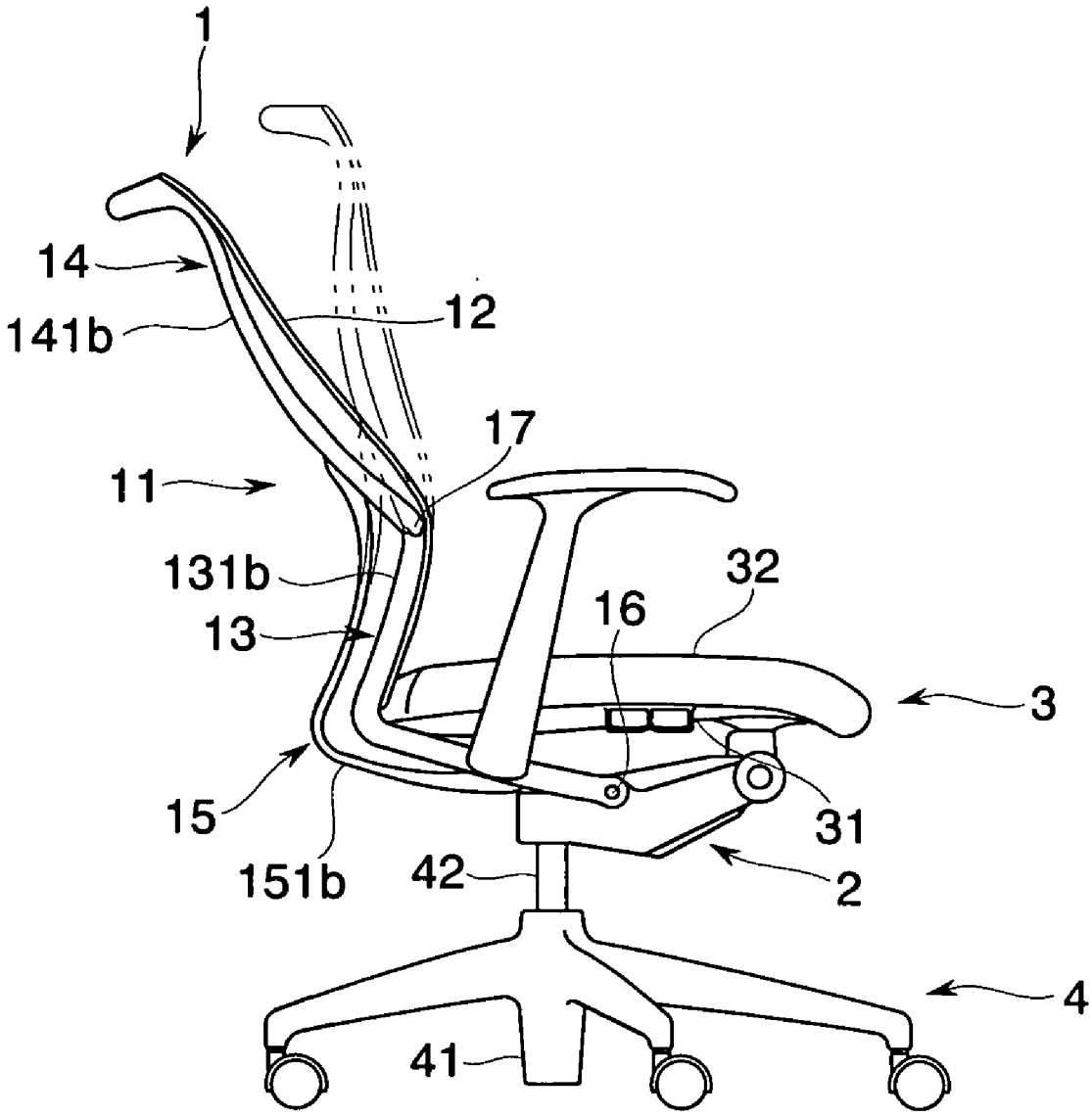
FIG. 7 is a side elevational view showing a state in which an upper frame element of the chair is displaced backward.

As shown in FIG. 7, when backward tilting the upper frame elements 141*a* and 141*b* around the hinge 17, an area at which the upholstery member 12 is brought into contact with the portion forming the curved shape in the lower frame elements 131*a* and 131*b* and the upper frame elements 141*a* and 141*b* is increased step by step, and a distance between the upper end portion and the lower end portion of the back frame 11 is enlarged, whereby the upholstery fabric 121 is elongated up and down while increasing the tension. Further, at the same time, the lower end portion of the backup member 122 is relatively displaced in the vertical direction with respect to the lower frame elements 131*a* and 131*b* within a dimensional range of the long hole 122*y*. In addition, the reaction force frame elements 151*a* and 151*b* are deformed in such a manner as to expand the angle so as to accumulate the reaction force, and elastically energizes the upper frame elements 141*a* and 141*b* in a direction of returning to the original position, that is, forward.

Figure 8:
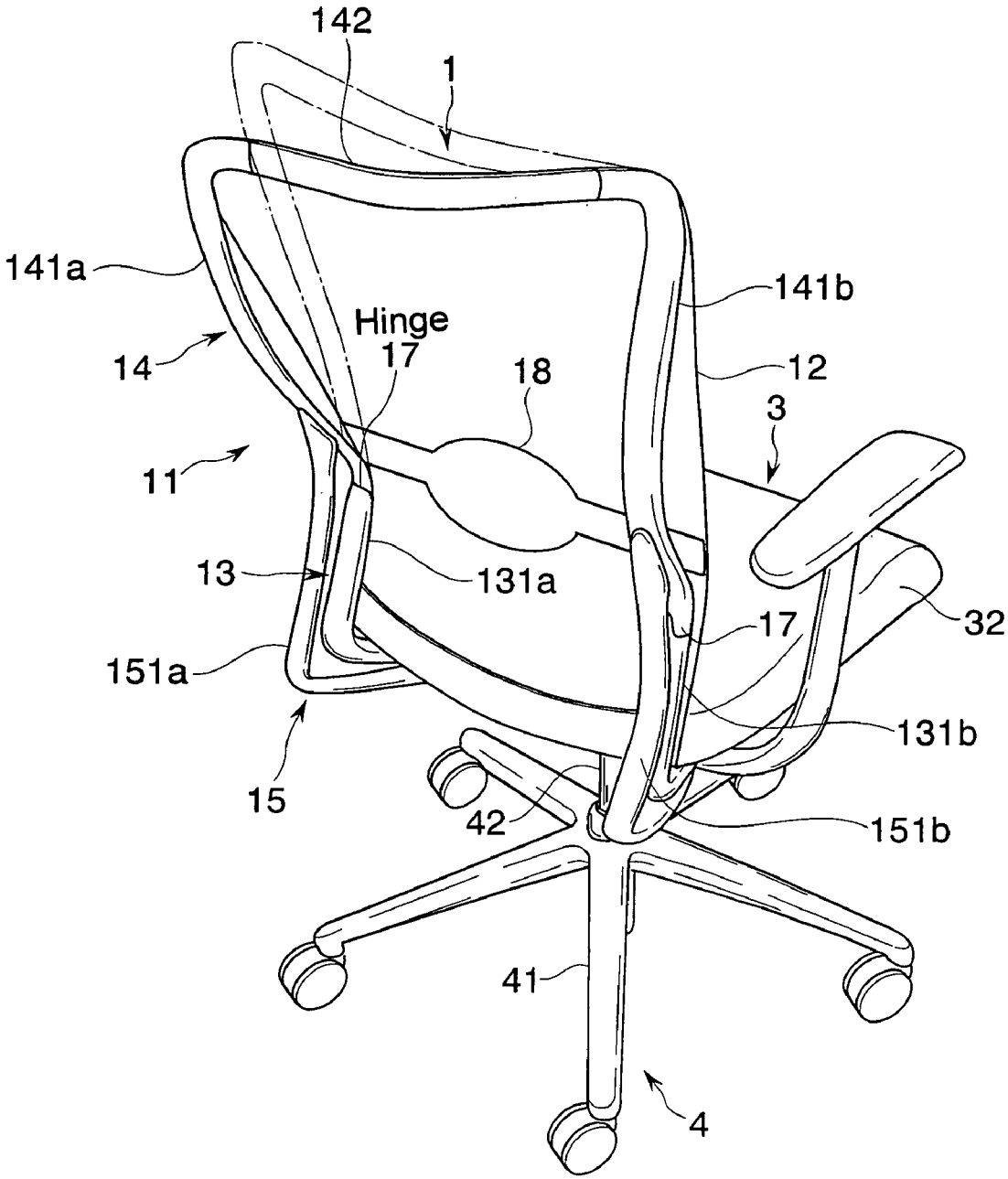
FIG. 8 is a perspective view showing a backrest surface deforming motion of the chair.
Figure 9:
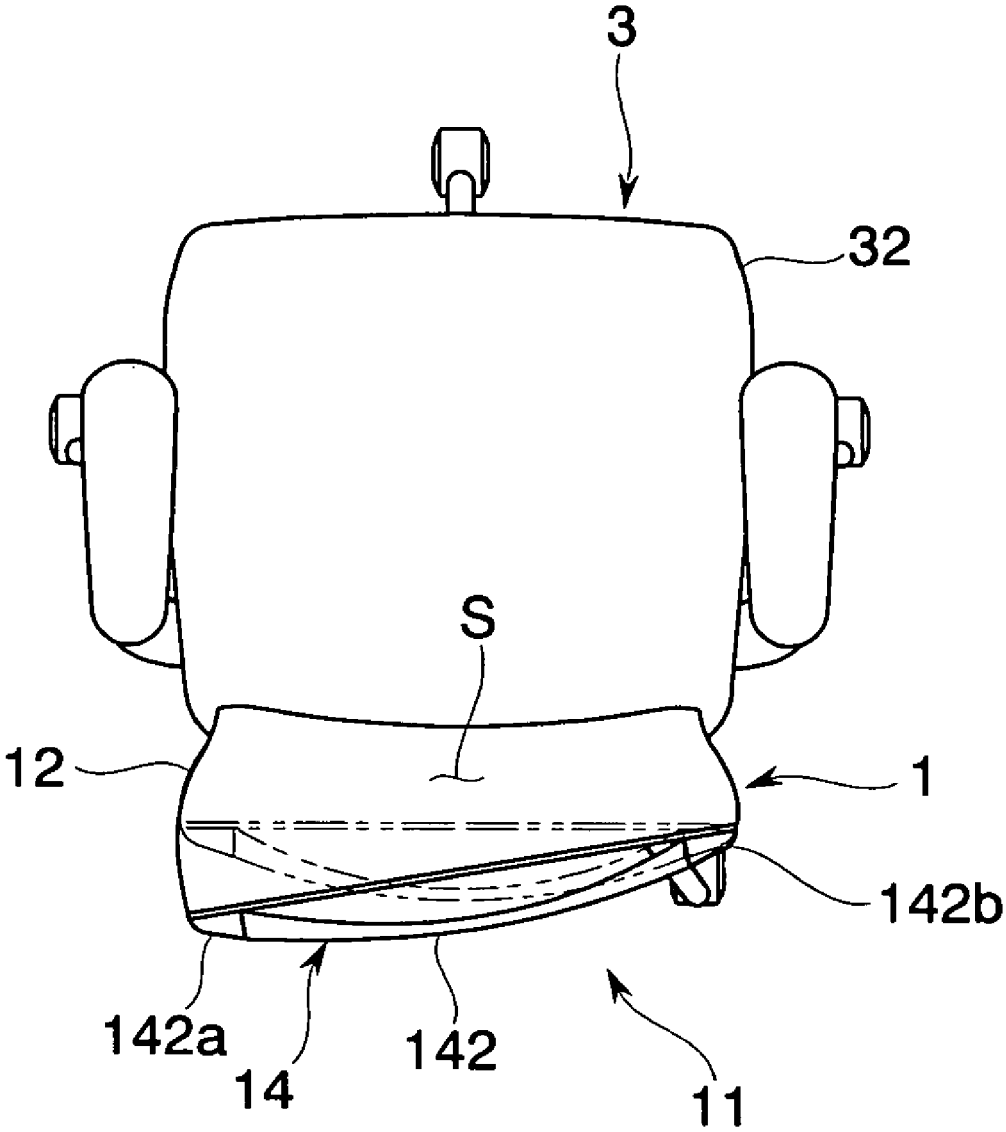
FIG. 9 is a plan view of the backrest surface deforming motion of the chair.

Further, if any one upper frame element 141*a* (141*b*) is relatively displaced in the backward and forward direction with respect to the other upper frame element 141*b* (141*a*), it is possible to three-dimensionally change the shape of the backrest surface S, as shown in FIGS. 8 and 9. In this motion, the lower frame portion 13 is not necessarily driven. Further, since the lower frame elements 131*a* and 131*b* forming a pair in the left and right sides are rigidly coupled to each other via the rigid lateral bridging member 132, the lower frame elements 131*a* and 131*b* are always moved integrally. Accordingly, the portion of the backrest surface S, that is, the portion below the lumber portion of the sitting person constantly maintains a fixed shape.

If one of the upper frame elements 141*a* and 141*b* is relatively moved backward and forward with respect to the other in accordance with the motion of the sitting person, the distance between the left and right upper frame elements 141*a* and 141*b* is increased. At this time, the elastic lateral bridging member 142 is elastically deformed so as to correspond to the increase of the distance between both the upper frame elements 141*a* and 141*b*. The elastic lateral bridging member 142 in accordance with the present embodiment couples the upper end portions of the upper frame elements 141*a* and 141*b* to each other, and is assembled in a state of forming the curved shape depressing to the rear side in the plan view. A thickness of front and rear sides of the elastic lateral bridging member 142 becomes gradually smaller toward the center in the width direction from both end portions coupled to the upper frame elements 141*a* and 141*b*, and the middle portion is comparatively easily deformed in comparison with both the end portions. This is because of avoiding concentration of the load to the coupled portion between the upper frame elements 141*a* and 141*b* and the elastic lateral bridging member 142.

Figure 12:
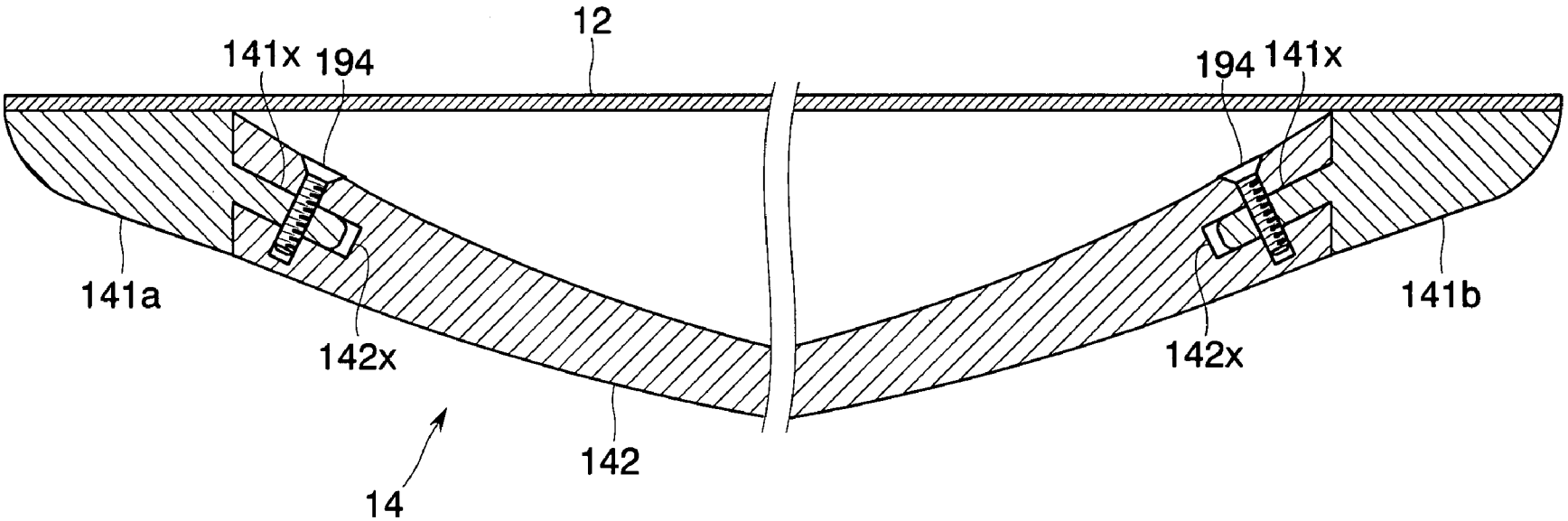
FIG. 12 is a plan cross sectional view of a major portion and shows an aspect of coupling between the upper frame element of the chair and an elastic horizontal member.

In this case, a description will be added to the coupling aspect between the upper frame elements 141*a* and 141*b* and the elastic lateral bridging member 142. The upper frame elements 141*a* and 141*b* are structured such that junction end portions are protruded to inner sides which are closer to each other in the upper ends, and both end portions of the elastic lateral bridging member 142 are connected to the junction end portions. As shown in FIG. 12, a convex portion 141*x* is provided in a protruding manner in one (the upper frame elements 141*a* and 141*b* side in the illustrated embodiment) of the junction end portions of the upper frame elements 141*a* and 141*b* and the facing end surfaces in both end portions of the elastic lateral bridging member 142, and a concave portion 142*x* is formed in the other (the elastic lateral bridging member 142 side in the illustrated embodiment), thereby constructing a fitting structure in which the convex portion 141*x* is fitted to the concave portion 142*x*. Further, the junction end portions of the upper frame elements 141*a* and 141*b* and the end portions of the elastic lateral bridging member 142 are connected by inserting a bolt 194 from a direction crossing the fitting direction and fastening peripheral walls of the convex portion 141*x* and the concave portion 142*x* by screw. In the illustrated embodiment, the bolt 194 is inserted from the front side, and the bolt 194 is almost covered by the upholstery member 12 provided in the back frame 11 in a tensional manner.

When one of the upper frame elements 141*a* and 141*b* are relatively moved backward and forward with respect to the other, the elastic lateral bridging member 142 is deformed in such a manner as to reduce the curvature so as to elongate the distance between both the ends.

In addition, the load of the sitting person applied to the backrest surface S acts on the upper frame elements 141*a* and 141*b* via the upholstery member 12, and applies the load to the hinge 17 so as to make the upper frame elements 141*a* and 141*b* come down to the inner side. For the purpose of canceling and reducing the load mentioned above, the elastic lateral bridging member 142 is assembled in a state in which the initial elastic force is achieved in such a manner as to set the upper frame elements 141*a* and 141*b* apart from each other in the width direction.

Further, it is possible to tilt both of the upper frame elements 141*a* and 141*b* in both the right and left sides. In this case, it is possible to achieve, for example, such a stretch motion as the sitting person deflects the back largely.

In accordance with the present embodiment, in the chair provided with the backrest 1 in which the upper portion of the backrest surface S is supported by a plurality of frame elements 141*a* and 141*b* arranged so as to be spaced with each other in the width direction, since each of the upper frame elements 141*a* and 141*b* can be independently moved backward and forward, it is possible to displace only the left half portion or the right half portion of the upper portion of the backrest surface S backward. Further, it is possible to three-dimensionally change the shape of the backrest surface S while following such the motion of the sitting person as looking around or the like, and it is possible to achieve the chair having an improved setting feeling which can preferably keep supporting the body without vainly limiting the motion of the sitting person.

Since each of a plurality of upper frame elements 141*a* and 141*b* supporting the upper portion of the backrest surface S can be individually displaced in the backward and forward direction without displacing the lower frame elements 131*a* and 131*b* supporting the lower portion of the backrest surface S, it is possible to properly fit to the natural attitude at a time when the sitting person looks around so as to prevent the additional load from being applied to the sitting person.

Since the structure is made such that the upper frame elements 141*a* and 141*b* are coupled to the lower frame elements 131*a* and 131*b* respectively via the hinges 17, and one of the upper frames 141*a* and 141*b* is relatively tilted backward with respect to the other, it is possible to selectively execute the rocking motion of integrally tilting the entire of the backrest surface S, and the backrest surface deforming motion of tilting only the upper portion of the backrest surface S. Of course, it is possible to simultaneously bring about the rocking motion and the backrest surface deforming motion, and the sitting person can pose various attitudes while sitting.

Since the reaction force frame elements 151*a* and 151*b* are provided in such a manner as to be connected to the back surfaces of the upper frame elements 141*a* and 141*b* supporting the upper portion of the backrest surface S so as to accumulate the reaction force, and the upper frame elements 141*a* and 141*b* are supported from the back side by the reaction force frame elements 151*a* and 151*b*, it is not necessary to inside install the coil spring or the like to the hinge 17 portion, and it is possible to prevent the hinge. 17 portion from being expanded. In addition, it is possible to prevent an uncomfortable feeling from being applied to the existence of the reaction force frame elements 151*a* and 151*b* by forming the reaction force frame elements 151*a* and 151*b* as an outer appearance like a part of the back frame 11, and it is possible to keep beauty and elegance as a furniture.

With regard to the matter that the upper frame elements 141*a* and 141*b* supporting the upper portion of the backrest surface S indirectly receives the load of the sitting person via the backrest surface S so as to tend to fall down in the width direction, it is possible to cope with the matter by coupling the upper frame elements 141*a* and 141*b* to each other via the elastically deformable lateral bridging member 142.

Further, since the lateral bridging member 142 is assembled in a state of achieving the initial elastic force such as to set the upper frame elements 141*a* and 141*b* apart from each other in the width direction, against the matter that the load is applied to the backrest surface S and the upper frame elements 141*a* and 141*b* tend to fall down to the inner side, it is possible to cancel and reduce the load applied to the upper frame elements 141*a* and 141*b* and the hinges 17.

Further, in correspondence to the motion of the sitting person, one of the upper frame elements 141*a* and 141*b* is relatively displaced with respect to the other and the distance between the upper frame elements 141*a* and 141*b* is increased. Accordingly, the lateral bridging member 142 is assembled in a state of being formed in the curved shape in the plan view so as to be deformed in such a manner as to reduce the curvature at a time when one of the upper frame elements 141*a* and 141*b* is relatively moved forward and backward with respect to the other, whereby it is possible to correspond to the increase of the clearance between the upper frame elements 141*a* and 141*b*.

The backrest surface S is structured by attaching the elastically deformable upholstery member 12 on the front surfaces of the plurality of upper frame elements 141*a* and 141*b*, whereby it is possible to provide the soft sitting feeling having the reduced load by deforming while following various motions of the sitting person and fitting to a wide range of the body.

Further, there is provided a connection structure between members, provided with a first member (the lower frame elements 131*a* and 131*b*) having a rigidity, a second member (the upper frame elements 141*a* and 141*b*) relatively movable with respect to the first member and having a rigidity, and a spring member (the reaction force frame elements 151*a* and 151*b*) structured such that one end portion and the other end portion are respectively connected to the first member and the second member so as to accumulate a reaction force, wherein the spring member is formed in a frame shape extending along the first member and the second member.

Both of the first member and the second member are constituted by a frame-shaped member, and the spring member is arranged so as to be approximately in parallel to the first member and the second member.

The first member and the second member are pivotally attached to each other in end portions.

The first member is constituted by a lower frame element structuring a lower portion of a backrest of a chair, and the second member is constituted by an upper frame element structuring an upper portion of the backrest.

Alternatively, the first member is constituted by a base body supporting a seat and the backrest of the chair, and the second member is constituted by a back frame structuring at least a part of the backrest of the chair.

The back frame is provided with at least a pair of the lower frame elements, the upper frame elements in which the lower ends are pivotally attached to the upper ends of the lower frame elements, and the spring members connecting the lower frame elements and the upper frame elements, in right and left sides, and the right and left upper frame elements are independently tiltable respectively.

In this case, the present invention is not limited to the embodiments in detail described above. Item by item speaking, there may be provided with a mechanism for fixing a relative displacement of the upper frame element and the upper portion of the backrest surface by extension by inhibiting the relative displacement of the upper frame element with respect to the lower frame element, that is, the rotation of the upper frame element around the hinge. For example, there can be considered a structure in which a push lock type gas spring is interposed between the lower frame element and the upper frame element, and the relative position of the upper frame element is fixed by inhibiting the expanding and contracting motion of the gas spring. Alternatively, there can be considered to mount a mechanism for protruding and contracting a stopper engaging with both of the lower frame element and the upper frame element so as to inhibit the relative displacement between the both.

Figure 13:
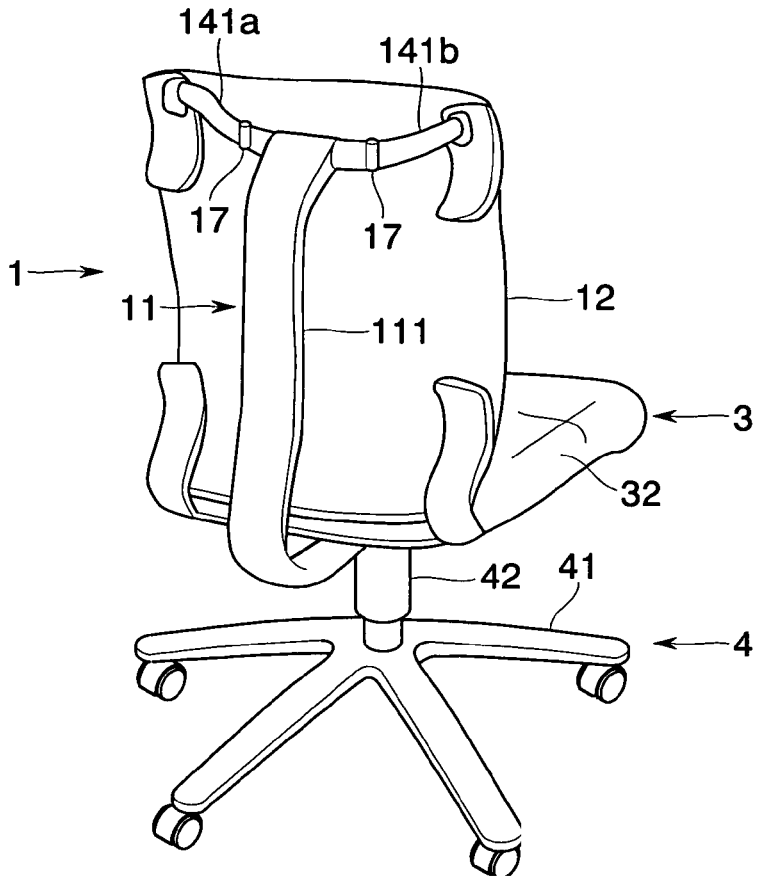
FIG. 13 is a perspective view showing a chain in accordance with a modified embodiment of the present invention.
Figure 14:
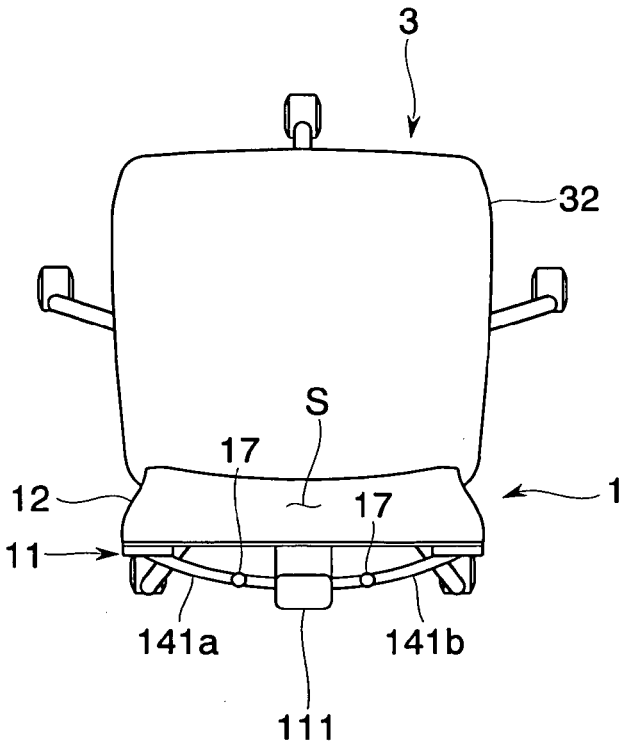
FIG. 14 is a plan view of the chair.
Figure 15:
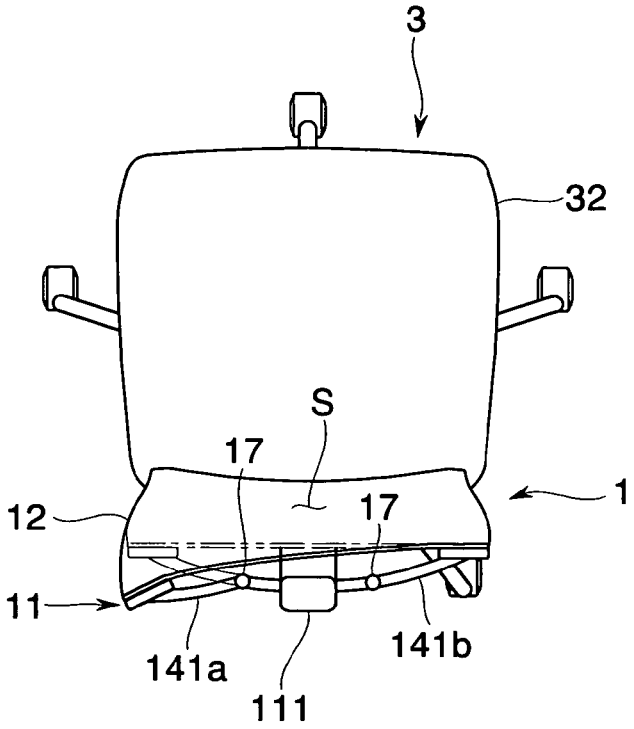
FIG. 15 is a plan view showing a backrest surface deforming motion of the chair.

The direction of the rotating shaft of the hinge rotatably supporting the upper frame element is not limited to the approximately horizontal width direction. The rotating shaft of the hinge may be inclined from the horizontal direction, or may stand erect approximately in parallel to the backrest surface. In fact, it is sufficient that the position supporting the upper portion of the backrest surface can be moved backward and forward, in the upper frame element. As exemplified in FIGS. 13 to 15, the structure may be made such that the back frame 11 is provided with a back support pillar 111, and the upper frame elements 141*a* and 141*b* coupled to the back support lever 111 via the hinges 17, and the upper frame elements 141*a* and 141*b* are rotated around an approximately perpendicularly rising shaft (or around the shaft approximately in parallel to the backrest surface S) so as to be displaced in the backward and forward direction.

Figure 16:
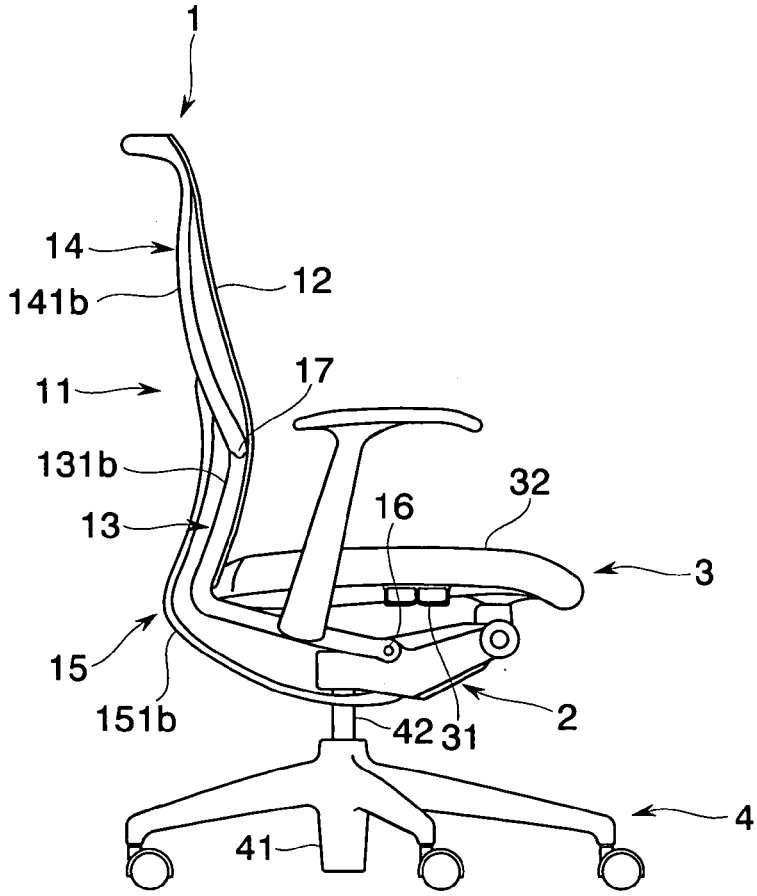
FIG. 16 is a side elevational view showing a chain in accordance with a modified embodiment of the present invention.
Figure 17:
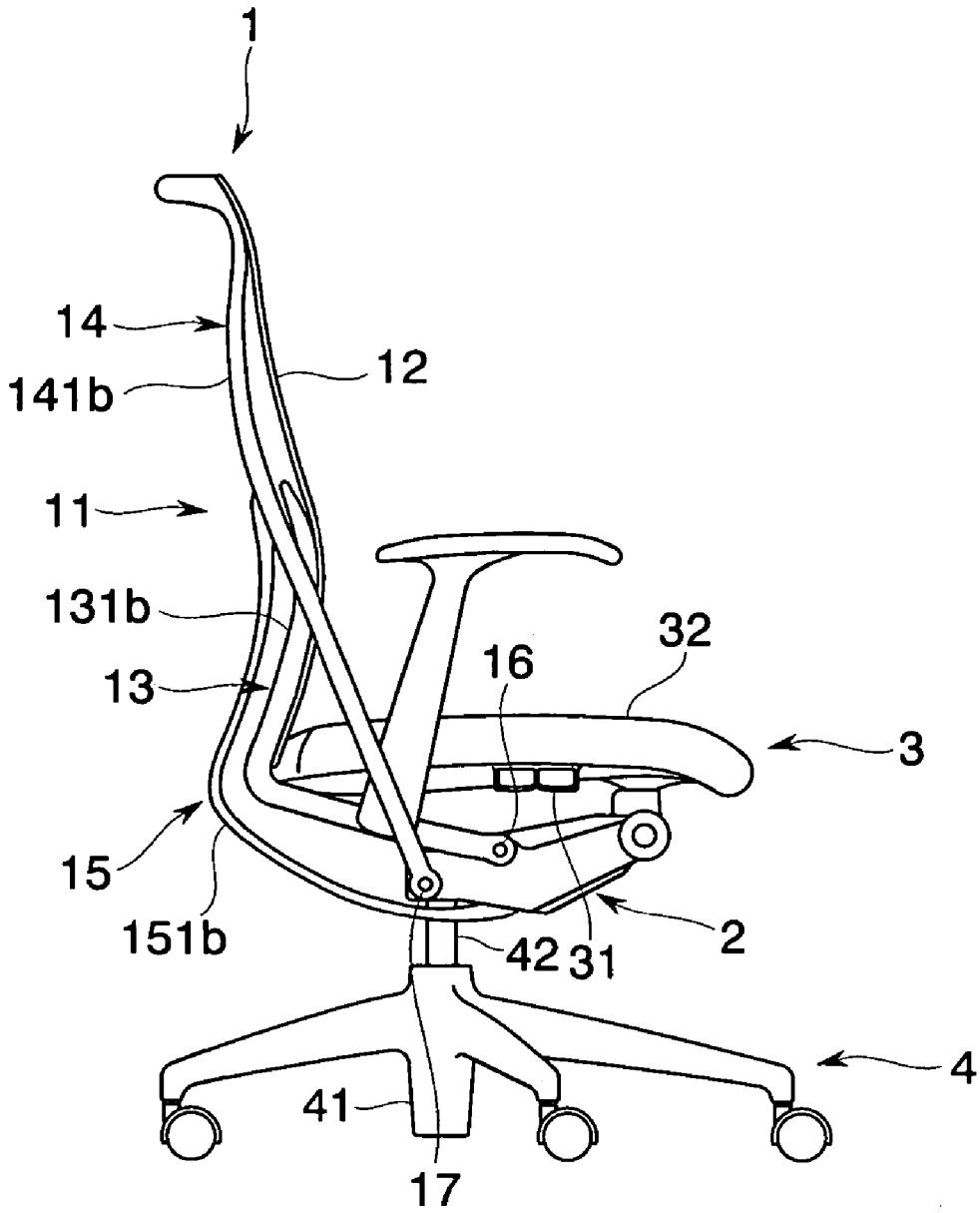
FIG. 17 is a side elevational view showing a chain in accordance with a modified embodiment of the present invention.
Figure 18:
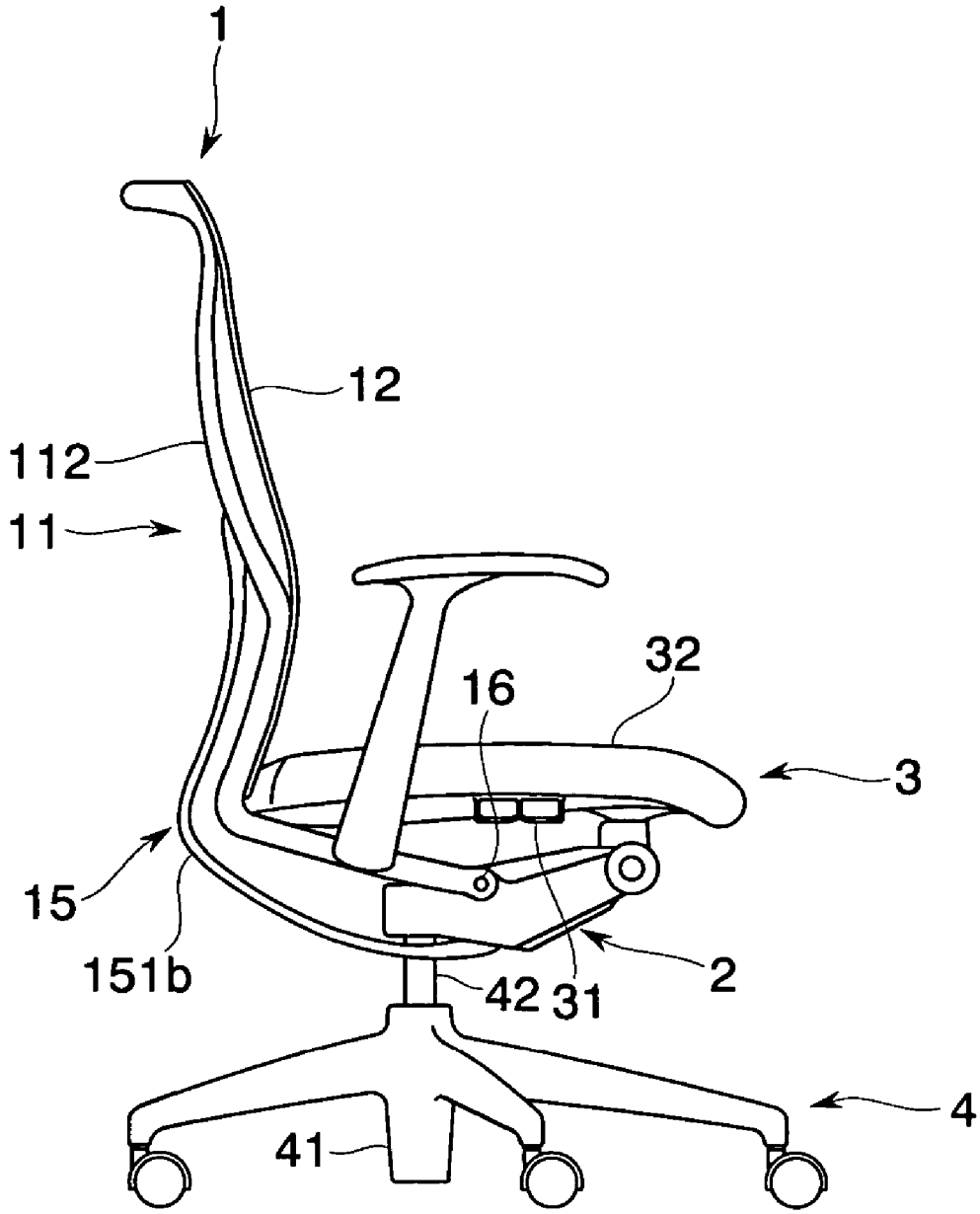
FIG. 18 is a side elevational view showing a chain in accordance with a modified embodiment of the present invention.

As exemplified in FIGS. 16 to 18, the other end portions of the reaction force frame elements 151*a* and 151*b* may be fixed to the base body 2 supporting the seat 3 and the backrest 1.

As exemplified in FIG. 17, it is possible to employ an aspect that the upper frame elements 141*a* and 141*b* are rotatably coupled to the base body 2.

As exemplified in FIG. 18, the structure may be made such that the lower frame elements and the upper frame elements are integrated, and the integrated right and left frame elements 112 are independently moved backward and forward to each other.

In a case where the lower frame element is constituted by the resin molded product or the like, it is possible to integrally form the lower frame elements and the reaction force frame elements. In the same manner, it is possible to integrally form the upper frame elements and the reaction force frame elements.

The upholstery member constituting the backrest surface is not limited to the double raschel mesh. As far as it is a soft surface material, it may be constituted, for example, by an elastomer resin material or the like.

In addition, the specific structures of the respective portions, the procedure of the processes and the like can be variously modified within the scope of the present invention.

What is claimed is:

1. A chair, comprising:

a backrest including a backrest surface, a plurality of frame elements, each including a lower frame element and an upper frame element with a hinge disposed therebetween, said plurality of frame elements being spaced with each other in a width direction, and a plurality of reaction force frame elements, each of said plurality of reaction force frame elements being formed in an approximately L-shape in a side view and having a first end connected to a back surface of one of said plurality of upper frame elements and a second end connected to a downward surface of one of said plurality of lower frame elements, wherein each of said upper frame elements is supported with the hinge at a lower end thereof, and is independently movable backward and forward, wherein a distance between upper ends of each of said upper frame elements increases when a first one of said upper frame elements is moved backward with respect to a second one of said upper frame elements, wherein each of said upper frame elements supports an upper portion of said backrest surface and each of said lower frame elements supports a lower portion of said backrest surface, wherein each of said upper frame elements are individually displaceable in a backward and forward direction without displacing a corresponding one of said lower frame elements, and wherein when said upper frame element tilts backwards around said hinge, a reaction force is accumulated based on an elastic deformation of the reaction force frame elements.

2. The chair according to claim 1, wherein the plurality of upper frame elements are coupled to each other via an elastically deformable lateral bridging member.

3. The chair according to claim 2, wherein said elastically deformable lateral bridging member is assembled in a state of achieving an initial elastic force such as to set said plurality of frame elements apart from each other in the width direction.

4. The chair according to claim 3, wherein said lateral bridging member is assembled in a state of forming a curved shape in a plan view so as to be deformed in such a manner as to reduce a curvature when one of said plurality of frame elements is relatively moved backward and forward with respect to another of said plurality of frame elements.

5. The chair according to claim 3, wherein the backrest surface is structured by attaching an elastically deformable upholstery member on front surfaces of the plurality of frame elements.

6. The chair according to claim 2, wherein said lateral bridging member is assembled in a state of forming a curved shape in a plan view so as to be deformed in such a manner as to reduce a curvature when one of said plurality of frame elements is relatively moved backward and forward with respect to another of said plurality of frame elements.

7. The chair according to claim 6, wherein the backrest surface is structured by attaching an elastically deformable upholstery member on front surfaces of the plurality of frame elements.

8. The chair according to claim 2, wherein the backrest surface is structured by attaching an elastically deformable upholstery member on front surfaces of the plurality of frame elements.

9. The chair according to claim 1, wherein the backrest surface is structured by attaching an elastically deformable upholstery member on front surfaces of the plurality of frame elements.

* * * * *